US009450326B2

(12) United States Patent
Engels et al.

(10) Patent No.: US 9,450,326 B2
(45) Date of Patent: Sep. 20, 2016

(54) DATA CABLE CONNECTOR MODULE FOR ASSEMBLY TO CABLE WITH A FIXATION ELEMENT FOR POSITIONING AND FIXING OF CABLE CONDUCTORS OF A MULTI CORE CABLE

(71) Applicant: LEONI Kabel Holding GmbH, Nuremberg (DE)

(72) Inventors: Yvan Engels, Grossthiemig (DE); Ernst Klees, Munich (DE); Joachim Zellner, Rinchnach (DE); Wolfgang Schuh, Stadtprozelten (DE)

(73) Assignee: LEONI Kabel Holding GmbH, Neurnberg (DE)

( * ) Notice: Subject to any disclaimer, the term of this patent is extended or adjusted under 35 U.S.C. 154(b) by 649 days.

(21) Appl. No.: 13/836,078

(22) Filed: Mar. 15, 2013

(65) Prior Publication Data

US 2013/0203282 A1 Aug. 8, 2013

Related U.S. Application Data

(63) Continuation-in-part of application No. 13/325,252, filed on Dec. 14, 2011, now Pat. No. 8,650,750.

(30) Foreign Application Priority Data

Dec. 17, 2010 (EP) ..... 10195716

(51) Int. Cl.
*H01R 13/648* (2006.01)
*H01R 13/502* (2006.01)
(Continued)

(52) U.S. Cl.
CPC ..... *H01R 13/502* (2013.01); *H01R 13/6585* (2013.01); *H01R 13/6586* (2013.01); *H01R 4/2433* (2013.01); *H01R 13/506* (2013.01); *H01R 13/6461* (2013.01); *H01R 24/64* (2013.01)

(58) Field of Classification Search
CPC ..... H01R 13/502; H01R 13/648; H01R 13/6485; H01R 13/6581; H01R 13/6585; H01R 13/6586
USPC ..... 439/389, 404, 405, 417, 676, 607.08, 439/607.413
See application file for complete search history.

(56) References Cited

U.S. PATENT DOCUMENTS 5,087,210 A * 2/1992 Myers ..... H01R 13/65802 439/425
5,624,274 A 4/1997 Lin
(Continued)

FOREIGN PATENT DOCUMENTS

DE 10 2004 004229 A1 8/2005
EP 0 982 815 A2 3/2000

*Primary Examiner* — Chandrika Prasad
(74) *Attorney, Agent, or Firm* — David S. Safran

(57) ABSTRACT

A data cable connector module with a fixation element for positioning and fixation of cable conductors of a multi core cable, with: conductor receiving units with conductor guide and connection openings for bent IDCs, IDC receiving units for fixation of connected IDCs with contact openings; a centric metallic shield star which shields each conductor pair and is electrically conductively connected with the housing of the fixation element; and a detachably connectable, changeable contact module with a metal housing, an isolation socket for receiving bent slide contacts with connector ends for connection to a circuit board which connects the slide contacts and the module plug-in contacts, a front connector face for external connectors; and a fixation element connector face with in at least one end isolator block guided module plug-in contacts. The fixation element and the contact module are electrically conductively connectable with the IDCs.

2 Claims, 6 Drawing Sheets

(51) Int. Cl.

| | |
|---|---|
| ***H01R 13/6586*** | (2011.01) |
| ***H01R 13/6585*** | (2011.01) |
| *H01R 4/24* | (2006.01) |
| *H01R 13/506* | (2006.01) |
| *H01R 13/6461* | (2011.01) |
| *H01R 24/64* | (2011.01) |

(56) References Cited

U.S. PATENT DOCUMENTS

| | | | | |
|---|---|---|---|---|
| 6,224,423 | B1 | 5/2001 | Yip et al. | |
| 6,287,149 | B1 | 9/2001 | Elkhatib et al. | |
| 7,182,649 | B2 | 2/2007 | Caveney et al. | |
| 7,195,518 | B2 | 3/2007 | Bert et al. | |
| 7,306,479 | B1 | 12/2007 | Wu | |
| 8,043,114 | B2 * | 10/2011 | Kaneko | H01R 13/65802 439/468 |
| 2011/0151708 | A1 * | 6/2011 | Kaneko | H01R 13/65802 439/404 |
| 2012/0021636 | A1 * | 1/2012 | Debenedictis | H01R 4/2429 439/391 |
| 2012/0178282 | A1 * | 7/2012 | Engels | H01R 13/6585 439/389 |

* cited by examiner

DATA CABLE CONNECTOR MODULE FOR ASSEMBLY TO CABLE WITH A FIXATION ELEMENT FOR POSITIONING AND FIXING OF CABLE CONDUCTORS OF A MULTI CORE CABLE

CROSS REFERENCE TO RELATED APPLICATION

This application is a continuation-in-part of co-pending U.S. patent application Ser. No. 13/325,252.

BACKGROUND OF THE INVENTION

1. Field of the Invention

The invention relates to a data cable connector module as well as to a process for the assembly of such data cable connector module to a cable.

2. Description of Related Art

According to the state of the art resp. according to German Patent DE 10 2004 004 229 B4, it is known to assemble a contact module to a multi-core cable. This data cable connector module connected to an assembled multi-core cable with a cable plug and a socket element presents a great advantage over the formerly necessary new installation when changing the sockets/plugs, but it is still improvable.

The present data cable connector module is rather long, because it mainly comprises of three assembly units, a fixation element, in which the single cable conductors are fixed and arranged in a contactable spatially defined way; a sleeve element, in which the single conductors are guided shielded, and a changeable contact module with casing and with a standardized connector face.

The present contact module can be connected—only releasable by means of special tools—with its fixation element, and show on one side contacts for the fixation element connections and on the other side a common connection component, e.g., an RJ45 socket, as well as a sleeve element positioned in-between. The shielding of the single cable conductors relative to each other is obtained with the data cable connector module according to the state of the art mainly via metal plates, which are star-shaped incorporated in the sleeve element in an isolator, in order to shield cable pairs from other cable pairs and which are part of the contact module. A continuous external shield is missing and the connection of the inner shielding plate star at the fixation element—therefore the present data cable connector module tends to radiation leakages.

Therefore, with the state of the art data cable connector module only Cat. 7 can be achieved and it is not applicable in smaller cable channels. The non-continuous shielding is only applicable for transmission rates up to approx. 600 MHz, because radiation leakages occur and no sufficient return loss for frequencies of 1 GHz and an increase of the limiting value to 10 dB are possible. Therefore, the existing data cable connector module can only fulfill requirements of Cat. $6_A$ (ISO/IEC 11801), which corresponds to a common RJ45 plug.

After all, the known data cable connector module can only be disconnected from the sleeve element by using special tools, when it becomes necessary to assemble a new contact module, which also results in a limited replaceability (approx. 10 plug-ins). With the present data cable connector module an automatic assembly is difficult, respectively impossible. Therefore, the known data cable connector module is open to improvements. Because the conductor contacts are arranged in a circle, an automatic contact is not possible (access over 360° is very difficult).

SUMMARY OF THE INVENTION

It is an object of the invention to ameliorate the disadvantages of the state of the art.

According to the invention, this object is met with a data cable connector module having the features described herein as well as with a process for an automatic assembly of the data cable connector module.

The data cable connector module specified by the invention with:

- a fixation element for positioning and fixation of the cable conductors of a multi-core cable, which is positioned at the one end of the cable, with:
- conductor receiving units with conductor guide and connecting ports for bent insulation displacement contacts,
- insulation-displacement connector (IDC) receiving units for the fixation of the connected IDCs with contact openings;
- a centric metallic shield star, shielding each two conductors against other conductor pairs and which is in a conductive connection to the fixation element housing;
- a fixation element housing; and
- a detachable, with the fixation element connectable, changeable contact module with
- a contact module metal housing,
- isolator blocks arranged in a contact module metal housing for the reception of bent slide contacts with connector ends for connection to a circuit board;
- at least one circuit board, between slide contacts and module plug-in contacts, which connects the slide connector ends with the module plug-in contacts for the fixation element,
- a front connector face for external connectors according to the requirements; and
- a fixation element joint connector face with module plug-in contacts guided in at least one end isolator block, whereby the fixation element and the contact module are shaped to be brought into contact under establishing an electrical connection between module plug-in contacts with the IDC-contacts, so that the cable conductors of the fixation elements are in electrically conductive connection with the sleeve contacts of the contact module; enabling a surprisingly easy handling—respectively with changing of connector modules.

Generally, the fixation element is often named "cable plug", whereas the contact module is used as socket element, which is interchangeable by plugging according to the needs of the network.

The data cable connection module according to the invention shows better technical properties compared to known modules and a considerably simplified manufacturability and manageability.

The use of the advantageous new data cable connector modules is also possible with nets of 500≥1600 MHz, even up to over 3000 MHz (Cat. $7_A$) and the innovative data cable connector module corresponds with preparation of a suitable contact module—e.g., TERA-Cat$7_A$. The connector face may than arranged respectively (e.g., TERA or GG45).

With an advantageous design of the data cable connector module according to the invention, the fixation element as well as the contact module are polygon and have latching elements for a reversible openable—e.g., with a screwdriver—latch, as well as respective latching elements at the contact module.

At the fixation element as well as also at the contact module one or more devices for the centering and/or for the correct adjustment of the fixation element during the insertion in the back part of the contact module can be provided. Preferably, the front connector face of the changeable contact module meets the standards ISO/EC 11801 or EN 50173.

The invention also comprises advantageous, preferably at least partially automatically operation procedures for assembly of such data cable connection module in assembly automats, at least, however, partially workable, for assembly of such kind of data cable connector modules, with:

Producing of the fixation element connected to a data cable by:

- removing the cable mantle while exposing the isolated conductors of a data cable;
- inserting the isolated conductors into conductor receiving units with IDC openings;
- inserting of the bent ends of IDC contacts into the IDC contact openings of the conductor receiving units by cutting the conductor isolation and contacting the electrical conductors;
- sliding of IDC receptors onto the free ends of the IDCs;
- providing a shield star with outer shield elements to be put between/around the IDC receptors;
- placing of the configuration into a fixation element housing.

Producing of a contact module by:

- providing bent sliding contacts with connecting ends and slide contact parts;
- inserting same into an isolation holder;
- connecting at least one circuit board to the connecting ends of the slide contacts;
- connecting of connector module plug(s) with the circuit board(s) by providing an electrical connection between the slide contacts and the module plugs through the circuit boards(s);
- inserting the plugs in at least one end isolation unit and
- inserting of the configuration into a contact module housing, optionally having a shield star contacting the housing walls.

Especially because of the easy configuration of the data cable connector module with only a few components, an automatic assembly is possible without any problems.

The fixation element can be affixed easily to one cable end. To this end the cable is first stripped at its end part and brought into the fixation element housing, so that the stripped conductor ends—in this example, eight conductors—protrude into the fixation element and the cable mantle ends in the strain relief of the fixation element. The stripped conductor ends are arranged in pairs around a shielded cross with outer shield—the cable ends are provided with—from opposite of the cable—isolating conductor receiving units—also called pusher—having openings which are arranged vertically to the conductor-slots for bent IDCs. The IDC contacts, on the other hand, are arranged in IDC-receiving units, which also have contact openings for module plugs. With the installation of the IDC receiving units the isolation of the conductors is cut, thus producing electrical contact with the copper conductors and the IDC. This configuration is mounted in a fixation element housing. Now, a changeable contact module housing, which e.g., is equipped with a RJ45-socket or any other connection element, can be plugged to such a fixation element, which here is provided with a screwdriver or the like, openable locking unit.

The contact module can easily be produced by inserting bent slide contacts, which have connecting ends connected with at least one circuit board, in an isolation socket followed by installation of module plugs for the fixation element to the circuit board and sliding of a module housing over it. If the contact module shall comply with TERA standards, it is necessary to provide an isolation star electrically connected with the housing so that each contact pair is shielded against the neighboring contact pairs.

Due to the fact that by the fixation element the cable conductors can be arranged in a way that they may be plugged to the different contact modules (plugs), an according to the demands, fitting connecting element can be added or removed in an easy way without soldering or the like. Especially in case of changing the category of a network from Cat6 to Cat7 a very easy modification is possible, whereby it is not necessary to lay or connect new cables in an elaborated way. Due to the fact that in comparison to the common, on the market available contact modules according to German Patent DE 102004004229 B4, one complete component (the sleeve element, which is used there) is left out, an advantageous shorter assembly can be achieved. Compared to the known data cable connector module, which has a shield cross in the middle, having no sufficient distance to the conductors, no continuous shield and therefore no sufficient return loss, now a continuous complete shielding in the fixation element is available, which ends at the contacts of the fixation element, therefore the shielded part of the conductors is much shorter in comparison to DE 102004004229 B4 and a significant better return loss can be achieved. The system is therefore available for connector and network systems of higher quality EC7 resp. Cat7$_A$. With this construction technique it is also easy to mount or dismount the connectors to or from the fixation elements without special tools, whereby with the preferred embodiment a simple tool with a blade will be put into the closing device and screwed, whereby the locking between contact module and fixation element is opened. By the connector system according to the invention inter alia the following advantages are achieved:

- Simple conversion from RJ45 to Cat.7$_A$ components, possible by a better shielding in the fixation element
- Easier automatic and manual attachment, because of less parts
- Construction without cutting tools
- Easy to open without special tools, in case a disassembly is desired,
- Applicable in smaller cable channels than it was possible up to now, therefore a broader range of application.

Moreover, with the data cable connector module according to the invention, it will no longer be necessary to change or re-install the complete cabling including plugs, in case that one single front contact module is defect or if a different contact module is desired, but it is sufficient to separate the defect or undesired contact module from the fixation element in an easy and fast way and to plug-on a new contact module onto it.

Therefore, when changing the configuration of the connector face—e.g., in case of a necessary transition to another plug or socket type—this can be done easily without the, dreaded change of the complete, permanently connected cable contact module unit resp. cable plug unit known from the state of the art. Provided is, therefore, an improved data cable connector module, which, in case of damage of one single contact module, does not require the expensive, laborious and time consuming change of the complete, permanently connected cable contact module unit or cable plug unit and which enables fast, easy and cost-efficient realization of different connector face configurations and herewith a comfortable customization of the connector face to different mating plugs.

In the following the invention is described in more detail by means of, but not limited to, embodiments and the accompanying drawings.

BRIEF DESCRIPTION OF THE DRAWINGS

FIG. 2 is a schematic exploded view of an embodiment of the contact module for Cat.6a;

DETAILED DESCRIPTION OF THE INVENTION

Figure 1:
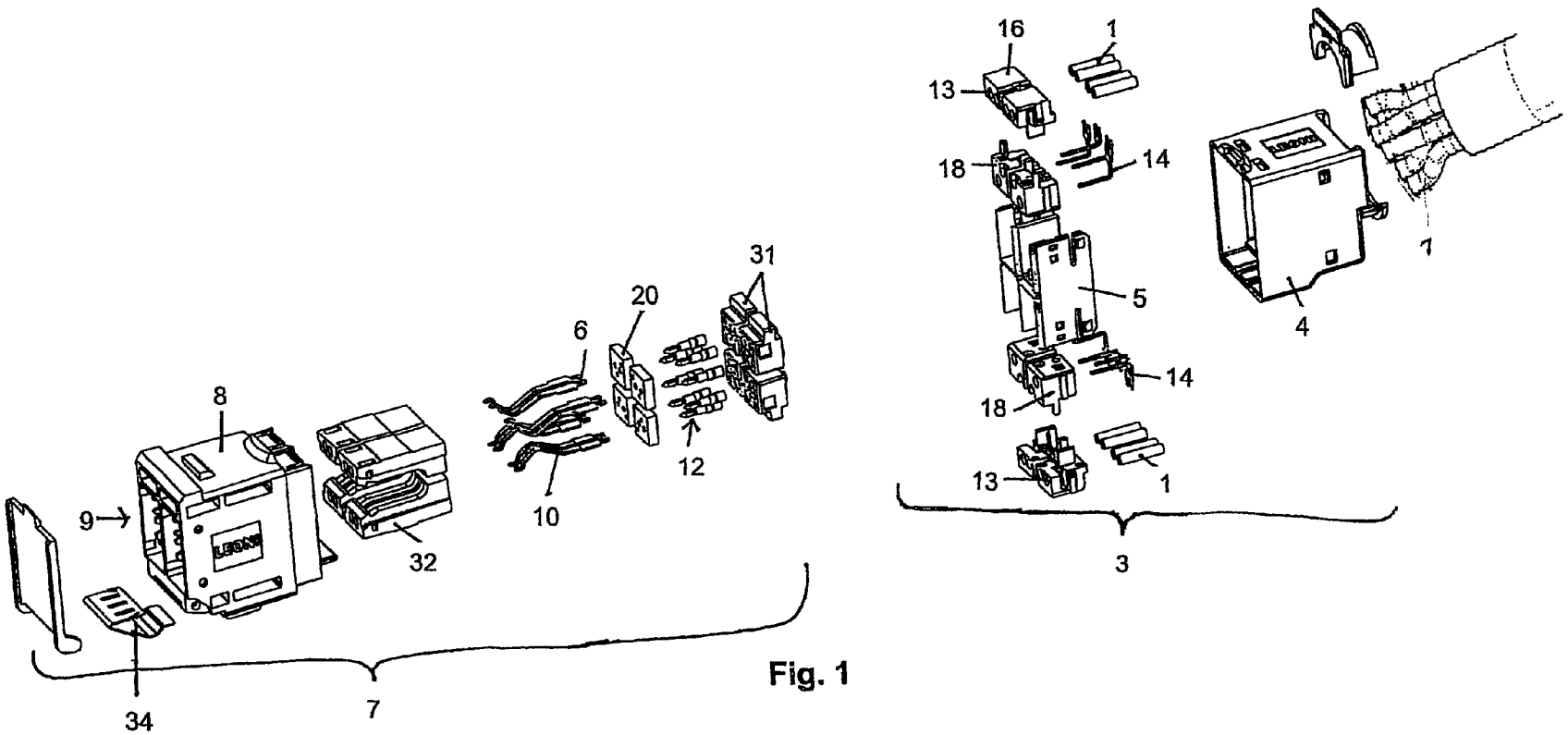
FIG. 1 is a schematic exploded view of the data cable connector module according to the invention.

As shown in FIG. 1, the data cable connector module according to the invention comprises a fixation element 3 for the positioning, separation and fixation of the conductors 1. This serves for the firm geometrical arrangement of the cable ends for plug connections. The fixation element 3 is fixed to the cable end, which has to be assembled with the data cable connector module, and comprises a fixation element housing 4 with cable inlet, transitions between conductors and contact units as well as corresponding shielding devices 5, which are shielding conductor pairs against each other and, moreover, an outer shield for the avoidance of electro-magnetic disturbances.

Figure 9:
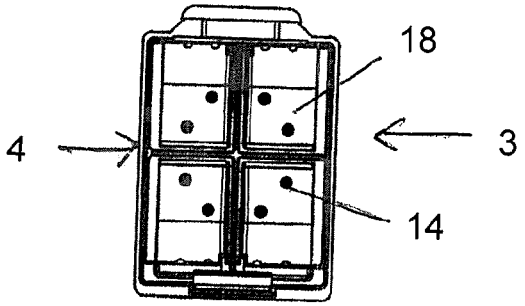
FIG. 9 is a front view of the fixation element.

Furthermore, in the embodiment as shown in FIGS. 1 & 9, the star-shaped branched shielding devices 5 (which might also be characterized as being cruciform shaped) have lateral shield plates for the in the in-between positioned conductor receiving units (pushers) 16 pair-wise fixed cable conductors 1 of a mult-core cable and other electric conductors (IDCs). In touch with the conductor receiving units, there is each one IDC receiving opening 18 for IDCs 14. The ICDs enter through a corresponding opening into the respective conductor receiving unit 16 and are thus cutting the conductor isolation of the respective cable conductors establishing electrical contact between the IDCs and the cable conductors 1. Outside of the conductor receiving units 16, the IDCs 14 extend to be connected with corresponding to module plug-in elements 12 of pluggable contact modules 7. Around this assembly, there is arranged a fixation element housing 4, which provides an outer shield and a cable strain relief as well as, if applicable, also fixation elements for the connection of contact modules 7.

Figure 10:
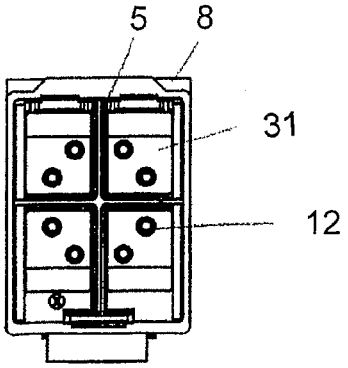
FIG. 10 is a front view of the contact module.
Figure 11:
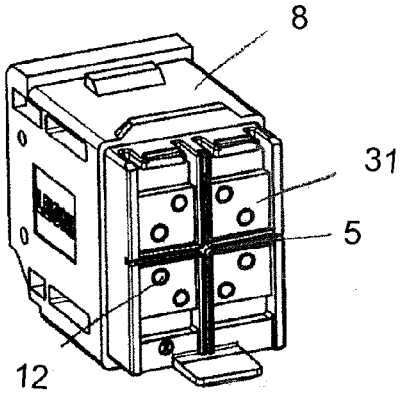
FIG. 11 is a frontal perspective side view of the TERA contact module.
Figure 8:
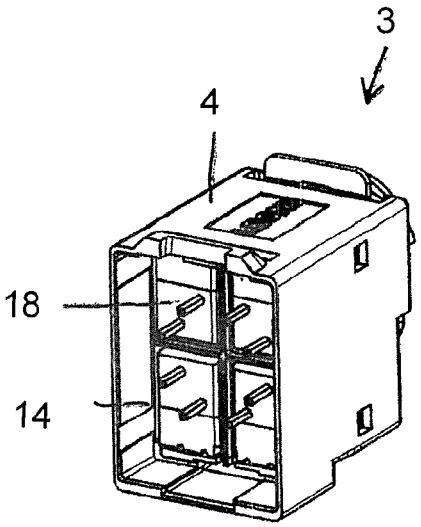
FIG. 8 is a perspective view of the fixation element from the contacting side.

The fixation element 3 ends at its front side with the IDC conductor receiving units 16 with sections of the IDCs 14 extending therefrom (see, FIGS. 8 & 9). Beyond the conductor receiving units 16, the free ends of the IDC's may be plugged in the end isolator block 31 of the contact module 7 holding the contact elements 12. The contact elements 12 are shown more clearly in FIG. 10 (front view of the contact module 7) or in FIG. 11. It is clearly shown that pins (here the IDC's 14 from the fixation element 3) can be inserted into the module plug-in contacts 12 of the contact module thus establishing electrical conduct between the cable conductors 1 ending in the fixation element and the module plug-in contacts 12 are connected to slide contact elements 10 of the contact module (in the case shown a Tera contact element).

Mounting of the fixation elements 3 to the data cable can be made reversible as well as irreversible. An irreversible mounting can, e.g., be produced by adhering, molding, clamping or grouting of the cable mantle with the fixation element 3.

Figure 3:
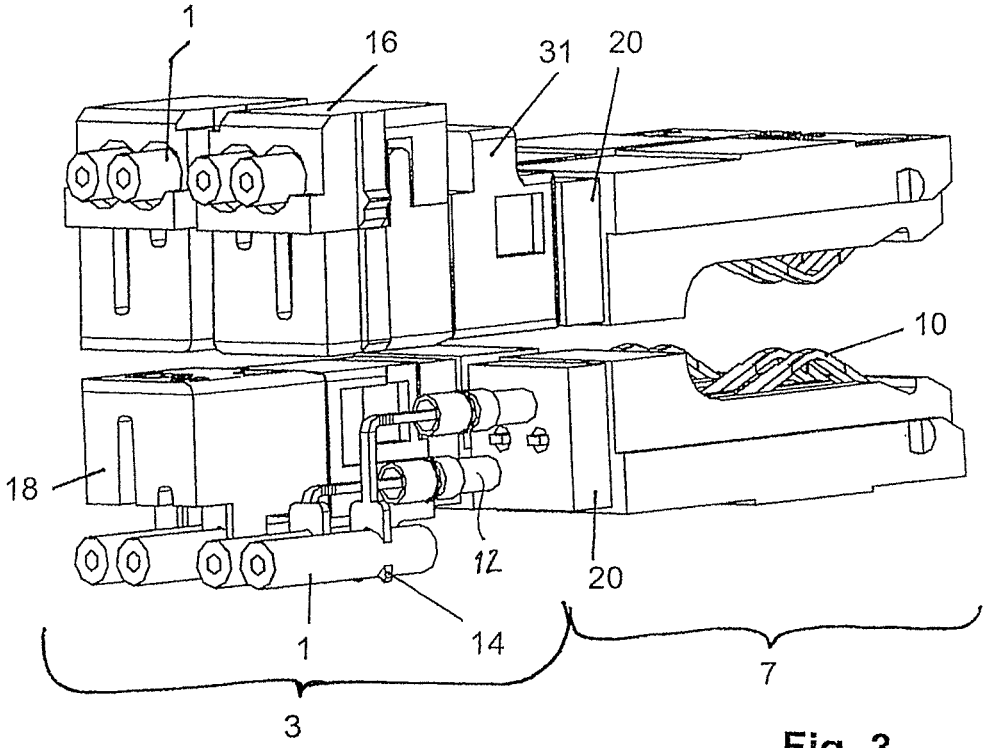
FIG. 3 is a detail of parts of fixation element and contact module that have to be connected with each other.
Figure 4:
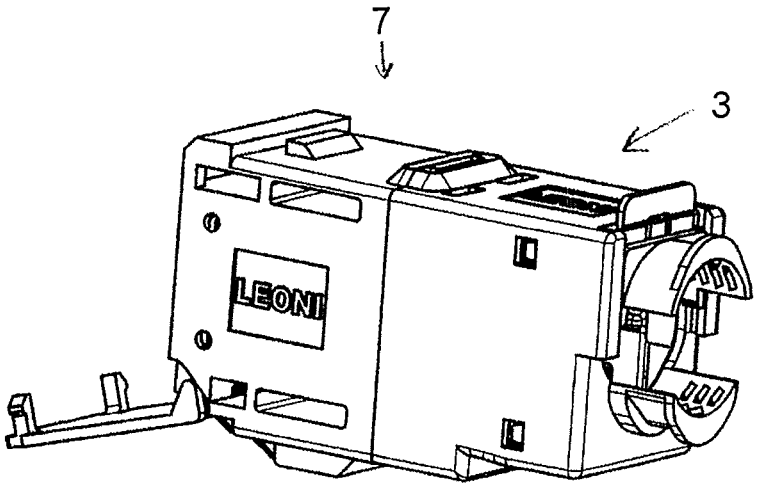
FIG. 4 is a perspective view of the assembled data cable connector module.
Figure 5:
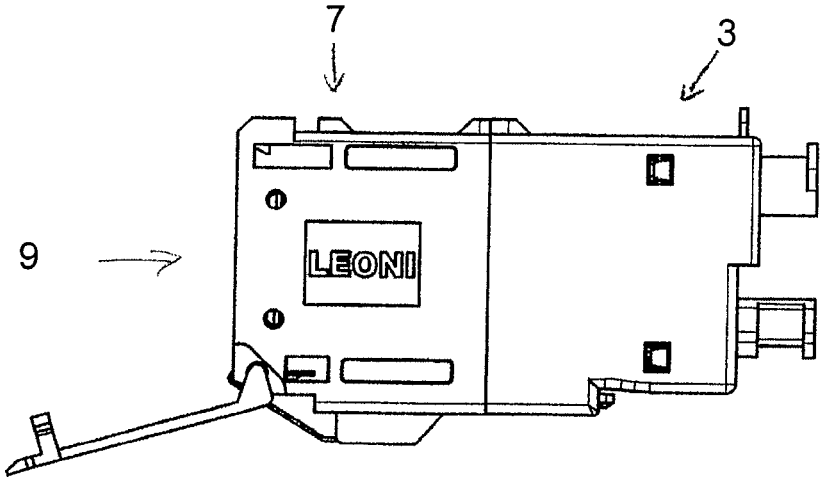
FIG. 5 is a side view of the assembled data cable connector module according to FIG. 4.

A reversible and changeable contact module 7 mountable to the fixation element 3—as developed in FIG. 1 as TERA connection module—has slide contacts 10 in a synthetic isolator block 32, who have connector ends 6 to a circuit board 20. The circuit board 20 connected/plugged hereto, connects the slide contacts with module plug-in contacts 12. The module plug-in contacts 12 are partly inserted in an end isolator block 31, who determines the geometrical assembly of them. The stick-like module plug-in contact ends, which are protruding out of the end isolator block 31 can be plugged electrically conductive to the front end of the IDCs 14 into plug openings in the IDC receiving unit 18 of the fixation element 3, thus connecting fixation element and contact modules, as in FIG. 3.

Figure 6:
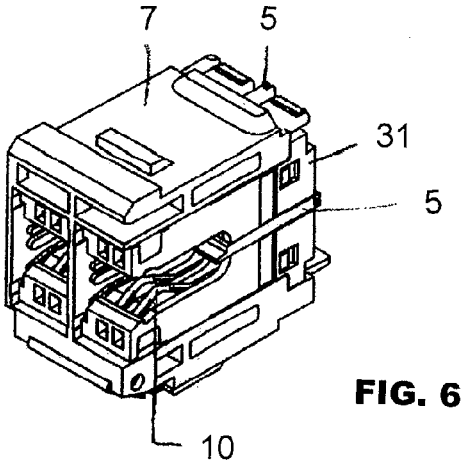
FIG. 6 is a side view of a Tera Contact module with the side wall of the housing 4 taken away
Figure 7:
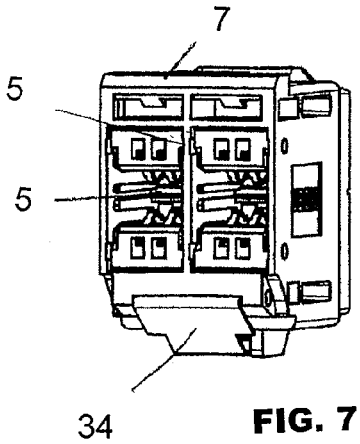
FIG. 7 is a perspective view of the Tera contact module of FIG. 6 from the contacting end

TERA contact modules 7 must have a shield star 5 to enable shielding between neighboring conductor pairs. The shield star 5 is shown more clearly in FIG. 6 which depicts a contact module without side wall for better clarity. The horizontal part of the shield does not extend to the end of the housing but ends at the slide contact elements to enable plugging of a state-of-the-art plug; whereas the vertical shield element of the shield star 5 extends through the housing 8 of the contact element 7.

FIG. 1 shows the contact module housing 8 in a front socket/connector face 9 according to TERA with electrically conductive slide contact 10 as well as, if applicable, a holding spring 34.

It is advantageous that, when joining the fixation element 3 according to the invention with the TERA contact element 7, that the shield stars contact each other thus enabling a complete shielding of the conductor pairs to comply with the regulations of TERA.

It is a further feature of the invention that the fixation element can be used to contact elements 7 of lower shielding classes, like RJ45.

Figure 2:
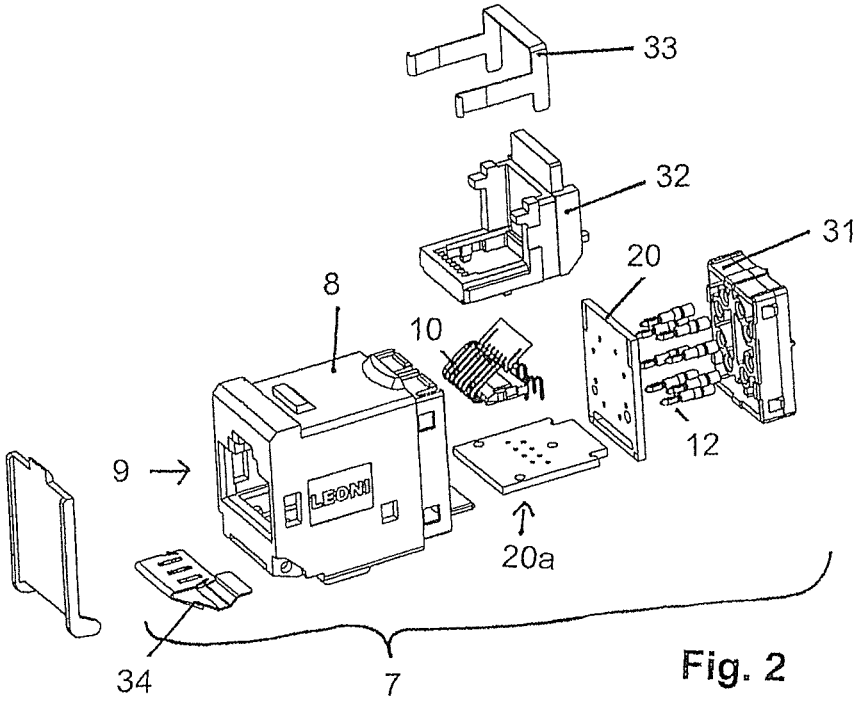

FIG. 2 shows a different embodiment of the contact module 7 as RJ45-element. With the RJ45-embodiment over a surface bent slide contacts 10 are installed on a circuit board in a way, that they create together with the circuit board and a compensation circuit board a connection and are mounted into a synthetic isolator block. The circuit board 20*a* is now plugged electrically conductive into a second circuit board 20, which connects the module plug-in contacts 12 of the contact module. The module plug-in contacts 12 are partly entered into an end isolator block 31, which stabilizes the contacts 12 during plugging and which closes the RJ45 contact module. This configuration is enclosed in the contact module housing 8, which has, if applicable, a holding spring 34 as well as a shield clamp 33 for the synthetic isolator block 32.

In the assembled condition, the ends of the module plug-in contacts 12 of the changeable contact module housing 8 are electrically conductive connected to the IDCs 14 in the IDC receiving unit 18. Normally, the fixation element is polygon, i.a. to achieve an easy positioning of the different plug/socket arrangements.

At the fixation element 3 may also be provided one or more provisions for centering and/or for the correct adjustment of the fixation element 3 during the plugging of the contact module 7, e.g., in the form of guide pins and fitting guiding slots.

With the automated production of the fixation element according to the invention, the cable mantle is first removed from the cable at its end and the thereby exposed cable conductors 1 are pulled into the fixation element housing 4. There the cable conductors 1 are pulled into the conductor receiving units 16, having IDC guides, through which can be connected in a right angle to the cable conductor 1 an IDC 14 to the cable conductor 1 by cutting the conductor isolation. The thus connected IDCs 14 are now bent at their free ends and brought into the openings of the IDC receiving units 18, which are arranged around a shield cross 5 with outer shield. Then the plugging and the connection of a contact module 7 can be managed at the ends of the IDCs which are accessible from outside through the openings in the respective IDC receiving unit 18.

A contact module 7 can also be produced automatically. At a contact module 7 according to TERA, as shown in FIG. 1 and in more detail also in FIG. 3, first the contact wires for the slide contacts 10 are inserted correctly bent in a synthetic isolator block 32 and are thereafter inserted together with the synthetic isolator block 32 into the contact module housing 8. The connector ends 6 of the slide contacts are ending on circuit boards 20. On the opposite side of the circuit boards 20 are—partially entered into the end isolation sockets—the module plug-in contacts 12. They can be plugged in the contact openings of the IDC units 14 of the fixation element 3 and can there establish a solid electrically conductive connection between the fixation element 3 and the contact module 7, without soldering or the like, in a cable reversible way. The data cable is thereby fitted with the desired connection modules and thus a reinstallation is made easier.

RJ45 modules, as shown in FIG. 2, can be produced automatically in a similar way. Thereby the slide contacts 10 are bent around a carrier, then inserted in a synthetic isolator block 32—if applicable, also with a compensation circuit—and connected by applying the aforesaid on a circuit board 20*a*, which is then entered into a further circuit board 20, positioned in a right angle hereto. The circuit board 20 carries the module plug-in contacts 12, partially received in a synthetic isolator block 32, like with the embodiment of the TERA-plug.

According hereto the contact modules as well as the fixation element can be produced automatically without any problems, respectively cables can be provided with them and a significant workload for reinstallation is avoided resp. the connection safety is improved.

Though the invention has been explained based on preferred embodiments, it will be apparent to those of ordinary skill in the art that the invention is in no way limited to the explained embodiments, but encompasses the knowledge of the person of ordinary skill in the art in the framework of the scope of protection of the claims.

What is claimed is:

1. A data cable connector module, comprising:

a fixation element 3 for positioning and fixing of cable conductors 1 of a multi-core cable, and which is connected to an end of the multi-core cable, with:

conductor receiving units 16 with a conductor guide 13 and connection openings for bent insulation-displacement connectors 14, insulation-displacement connector receiving units 18 with contact openings for reception of connected insulation-displacement connectors 14;

a centric metallic shield star 5, which shields each pair of the conductors of the multi-core cable relative to other pairs of the conductors of the multi-core cable and has an electrically conductive connection to a fixation element housing 4;

the fixation element housing 4; and a detachable, connectable to the fixation element, changeable contact module 7 with a contact module metal housing 8, an isolation socket 32 arranged in the contact module metal housing 9 for reception of bent slide contacts 10 with contact ends 6 for connection with a circuit board 20;

the circuit board 20 being positioned between the slide contacts 10 and the module plug-in contacts 12, and which connects the contact ends of the slide contacts 10 with the module plug-in contacts 12;

a front connector face for external connectors 9; and an isolator block 31 receiving at least one end of plug-in contacts 12 at one face and being connectable to the fixation element 3 at an opposite face, whereby the fixation element 3 and the contact module 7 are constructed in a form that can be brought into contact by establishing an electrically conductive connection of the module plug-in contacts 12 with the insulation-displacement connectors 14, so that the cable conductors 1 connected to the fixation element 3 are in an electrically conductive connection with the slide contacts of the contact module 7.

2. The data cable connector module according to claim 1, wherein the fixation element is polygonal.

* * * * *